United States Patent [19]

Bensley

[11] 4,343,057

[45] Aug. 10, 1982

[54] METHOD OF MAKING FOOTWEAR

[76] Inventor: Douglas W. Bensley, 1385 Commissioners Rd. West, London, Ontario, Canada

[21] Appl. No.: 148,611

[22] Filed: May 12, 1980

Related U.S. Application Data

[63] Continuation-in-part of Ser. No. 100,586, Dec. 5, 1979.

[51] Int. Cl.[3] ..... A43D 9/00; A43B 13/18; A43B 3/24

[52] U.S. Cl. ..... 12/142 D; 36/17 PW; 36/101

[58] Field of Search ..... 12/142 D, 142 T, 142 R; 36/100, 101, 17 A, 17 R, 17 PW, 78, 15, 11.5

[56] References Cited

U.S. PATENT DOCUMENTS

| | | | |
|---|---|---|---|
| 2,761,224 | 9/1956 | Gardiner | 36/11.5 |
| 3,012,341 | 12/1961 | Schaefer | 36/101 |
| 3,075,212 | 1/1963 | Sherbrook | 12/142 D |

*Primary Examiner*—Patrick D. Lawson

*Attorney, Agent, or Firm*—Robert F. Delbridge; Arne I. Fors

[57] ABSTRACT

A method of making an article of footwear includes attaching a connecting strip to the peripheral lower edge portion of a pre-formed upper so that the connecting strip surrounds the upper. The connecting strip has a profiled section providing a projecting extension, and a pre-formed ring-like welt member having an inner surface shaped for snapping engagement with the projecting extension of the connecting strip, is snapped into engagement with the connecting strip. A pre-formed sole and heel unit is then attached to the welt member by causing the upper peripheral surface of the sole and heel unit to adhere to the lower surface of the welt member. Alternatively, the pre-formed welt member may be omitted, and the pre-formed sole and heel unit snapped directly onto the connecting strip. In a further alternative arrangement, two separate connecting strips are used on opposite ends of the article of footwear.

3 Claims, 21 Drawing Figures

FIG. 12
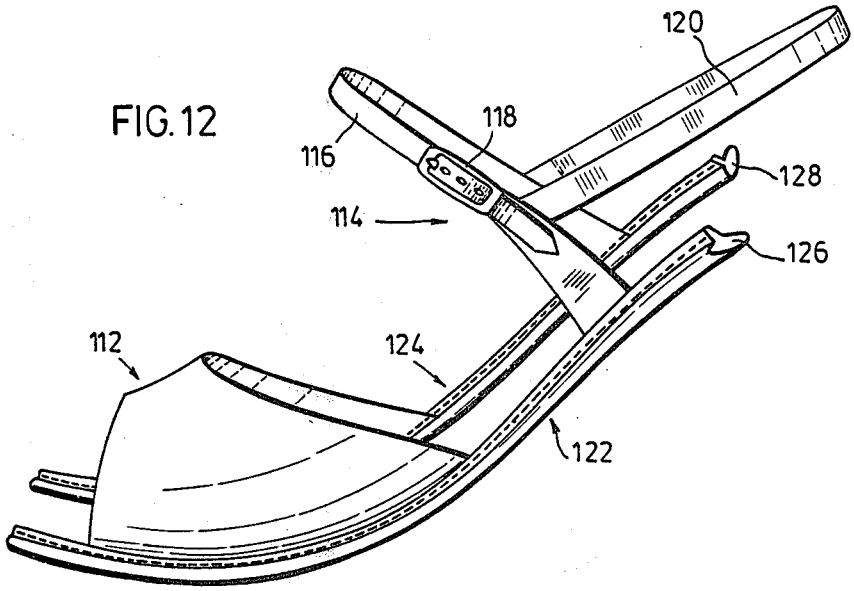
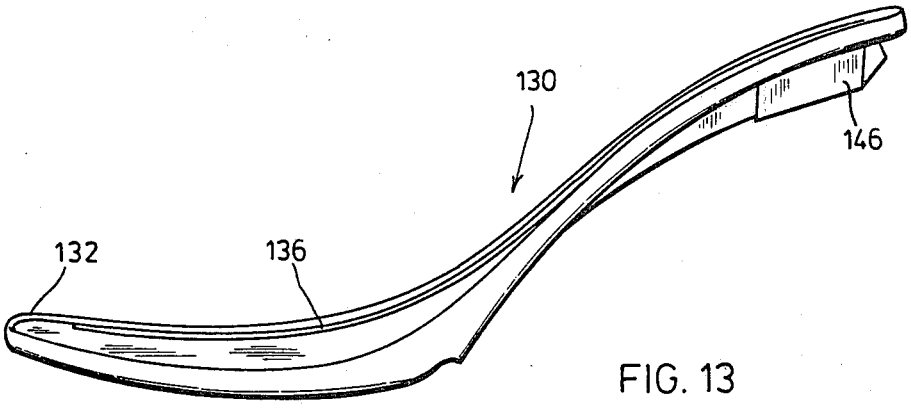
FIG. 13

FIG. 16.
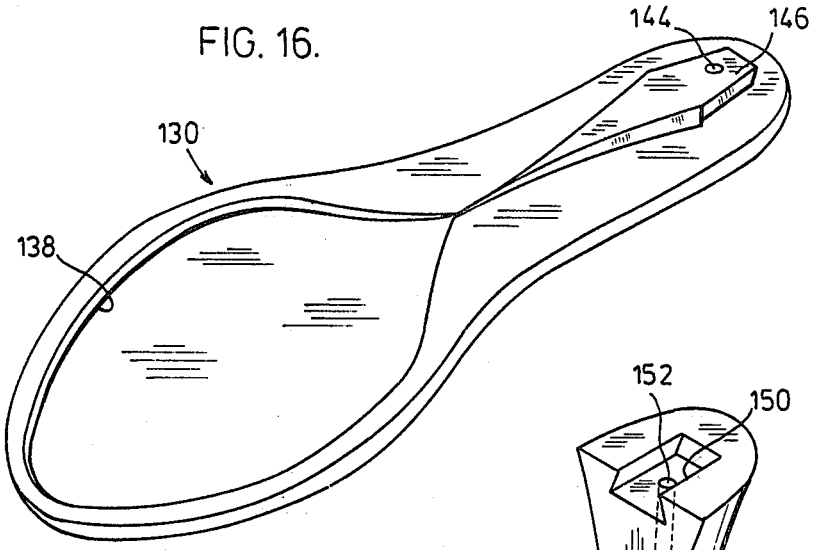
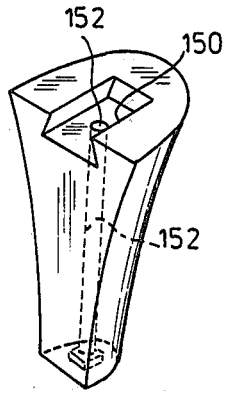
FIG. 17.
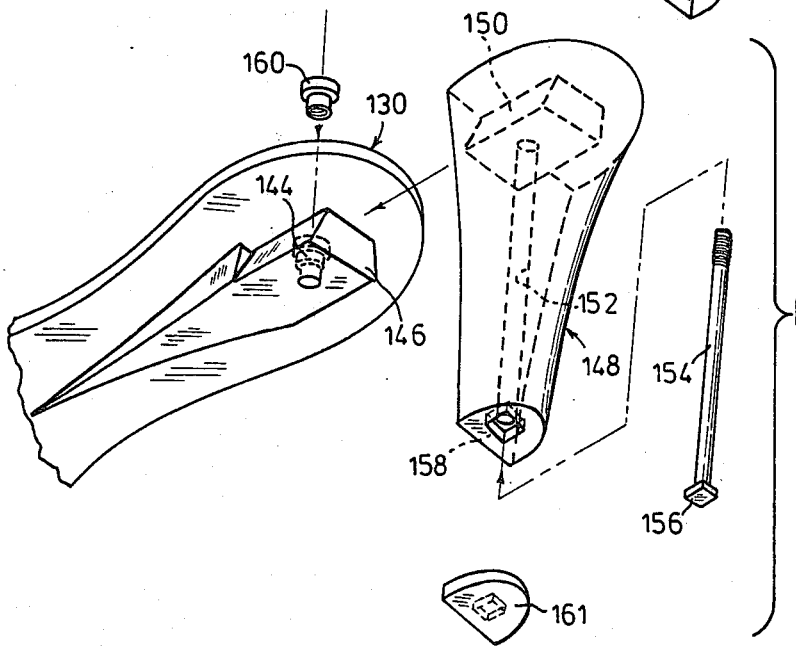
FIG.18.

FIG. 20.
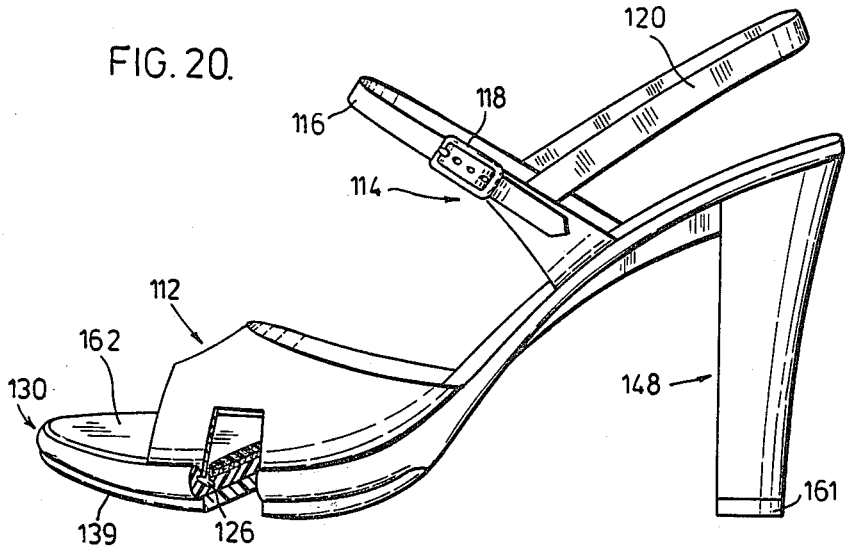
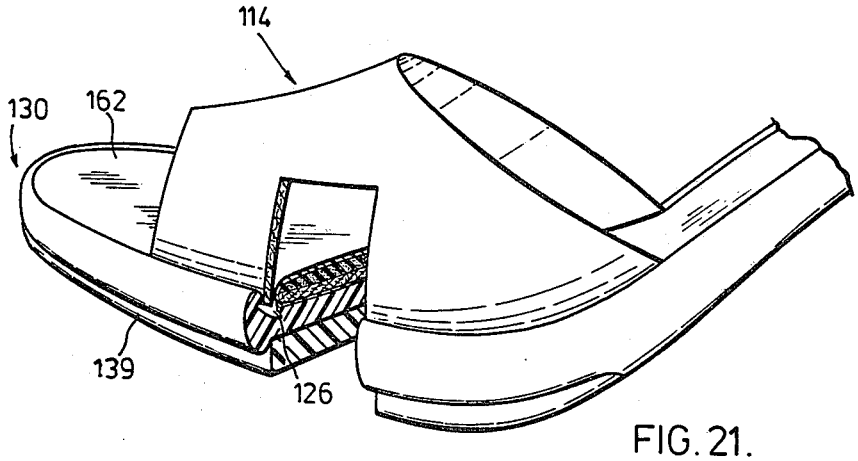
FIG. 21.

Figure 1:
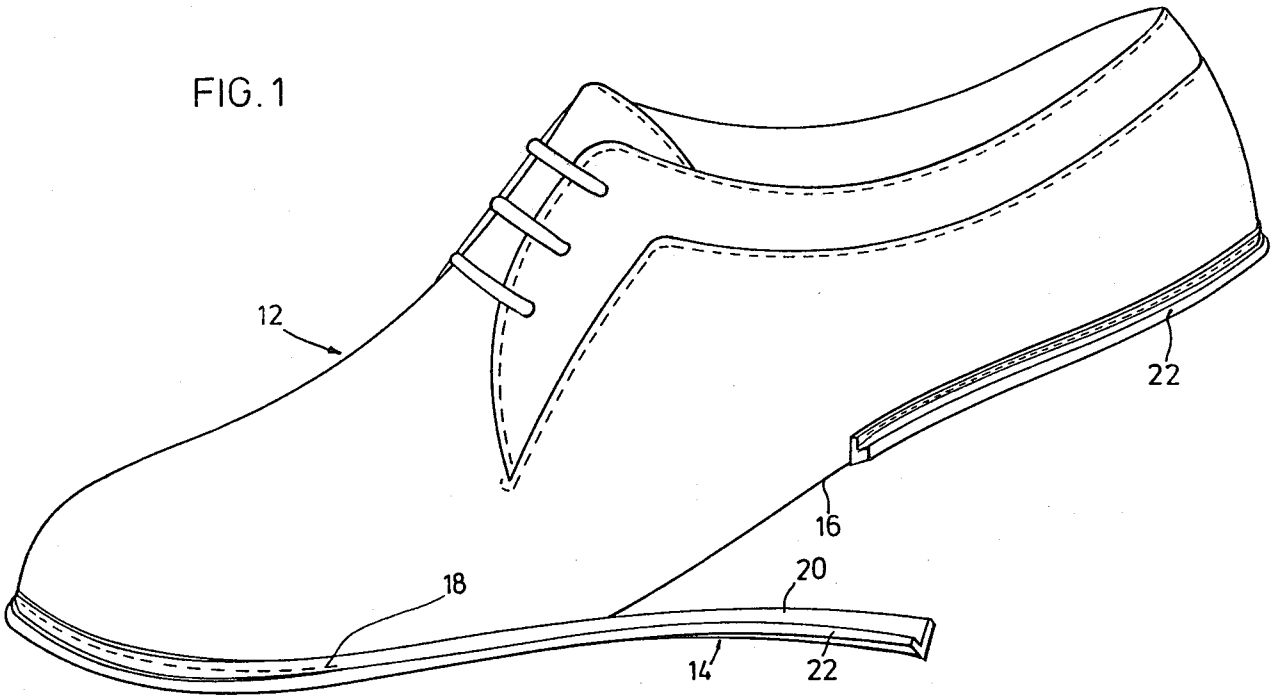
Figure 2:
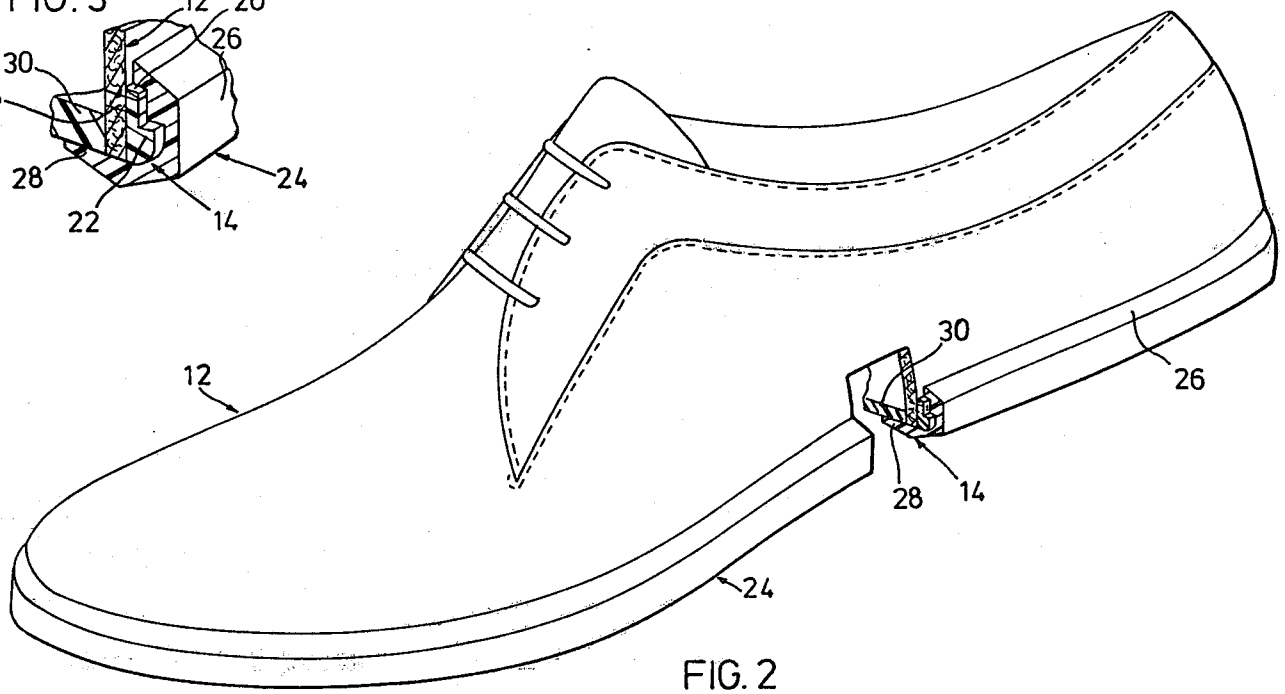
Figure 3:
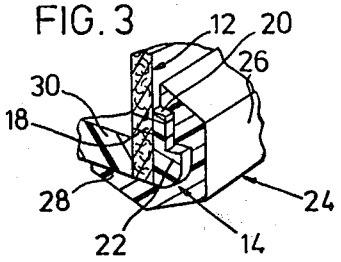
Figure 4:
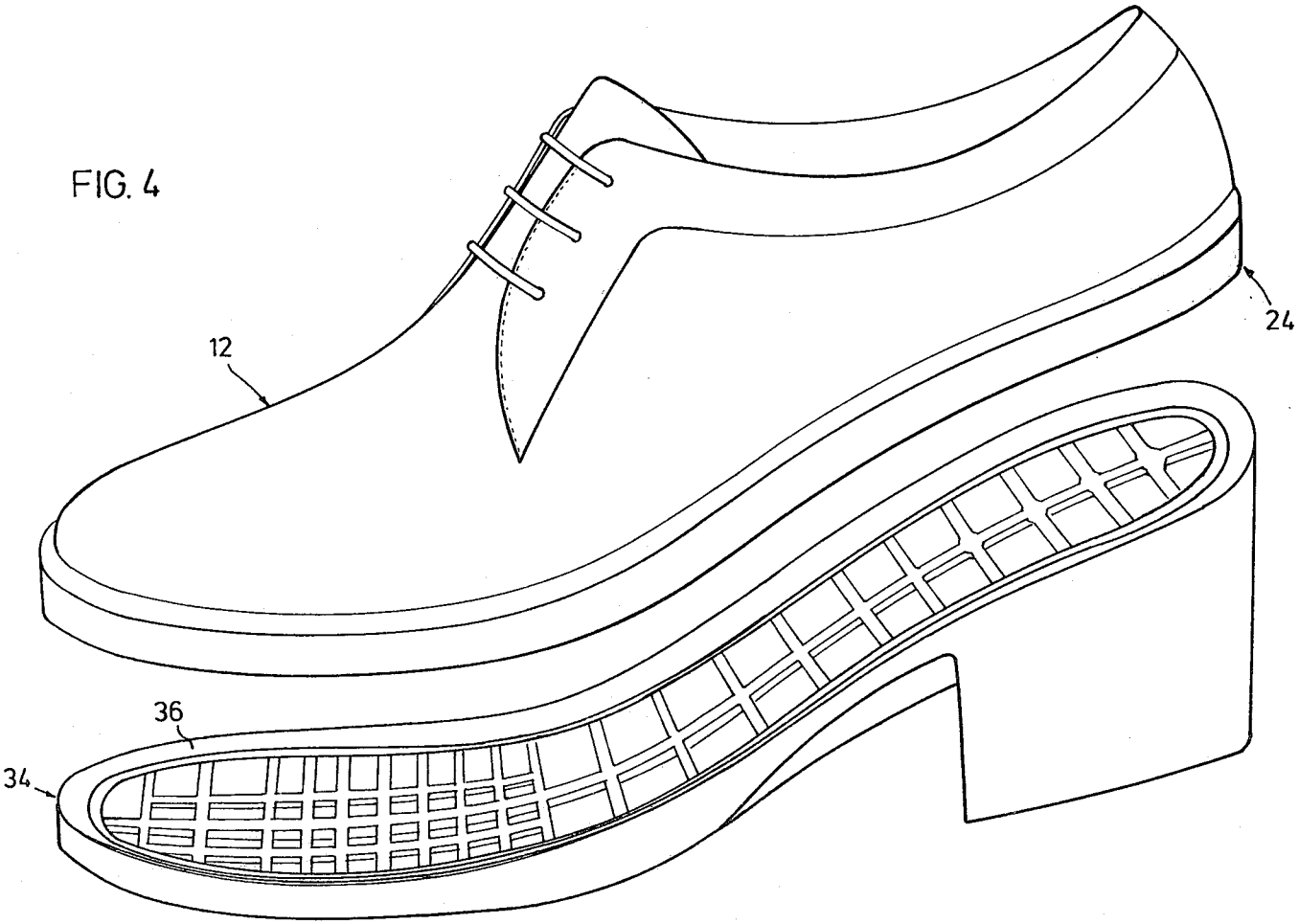
Figure 5:
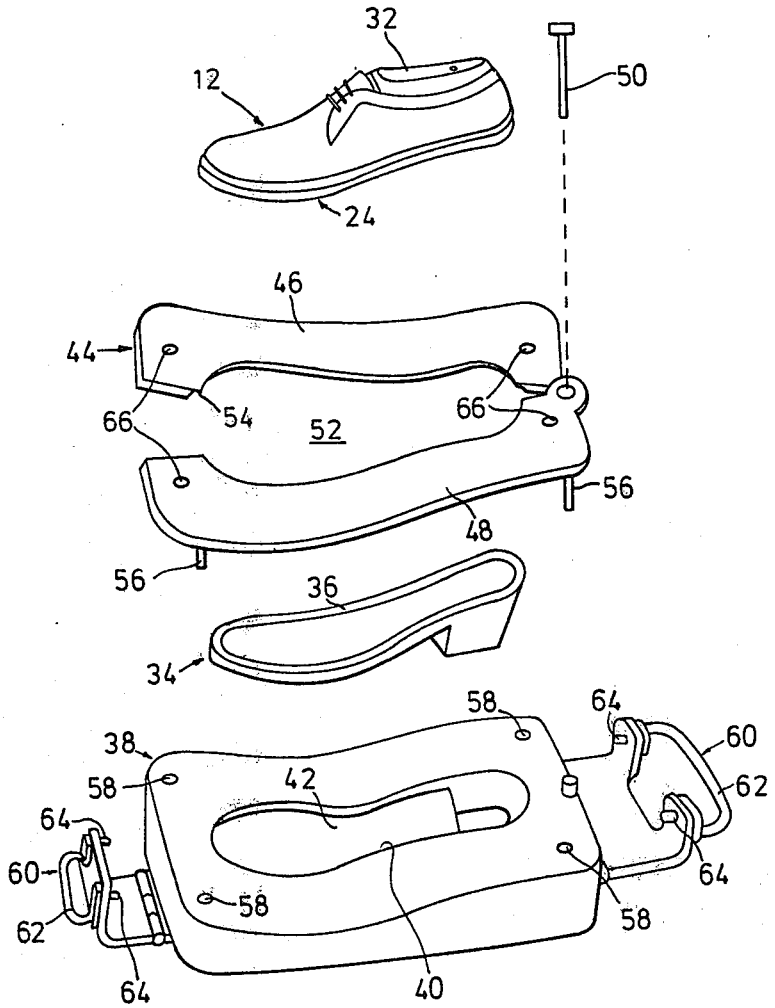
Figure 6:
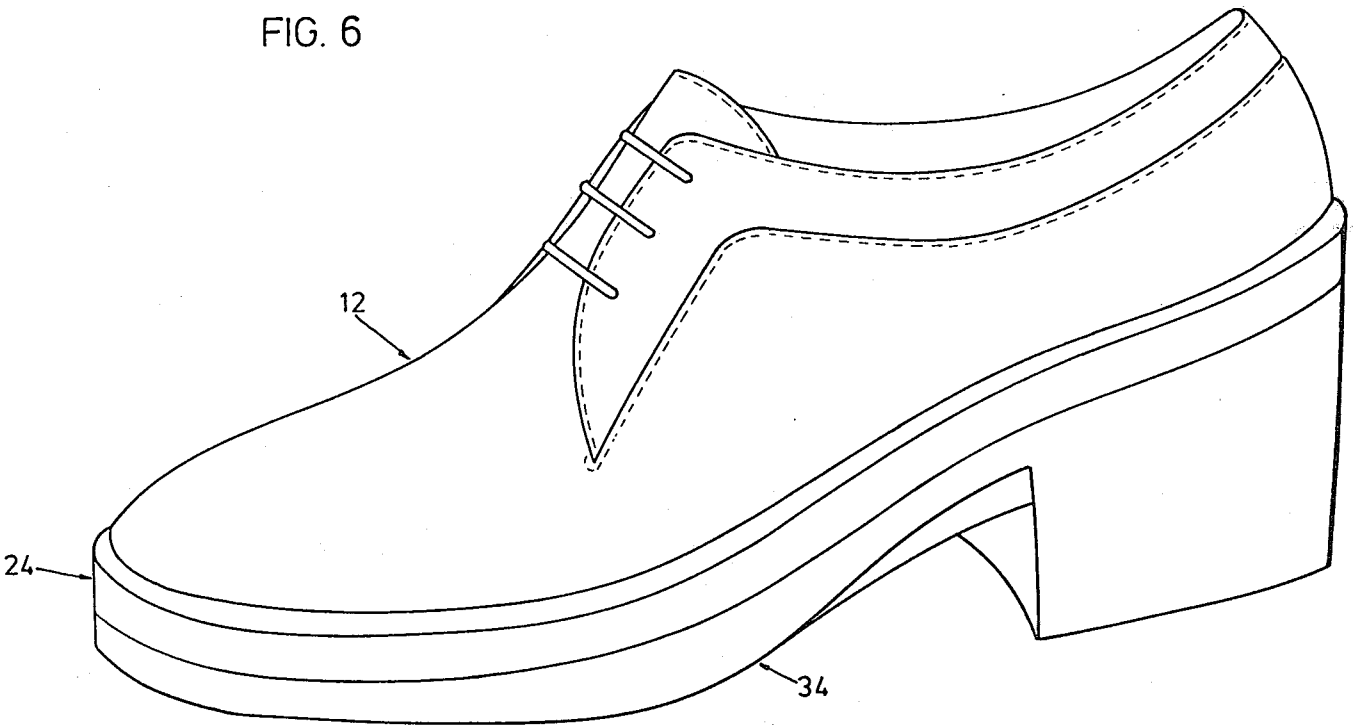
Figure 7:
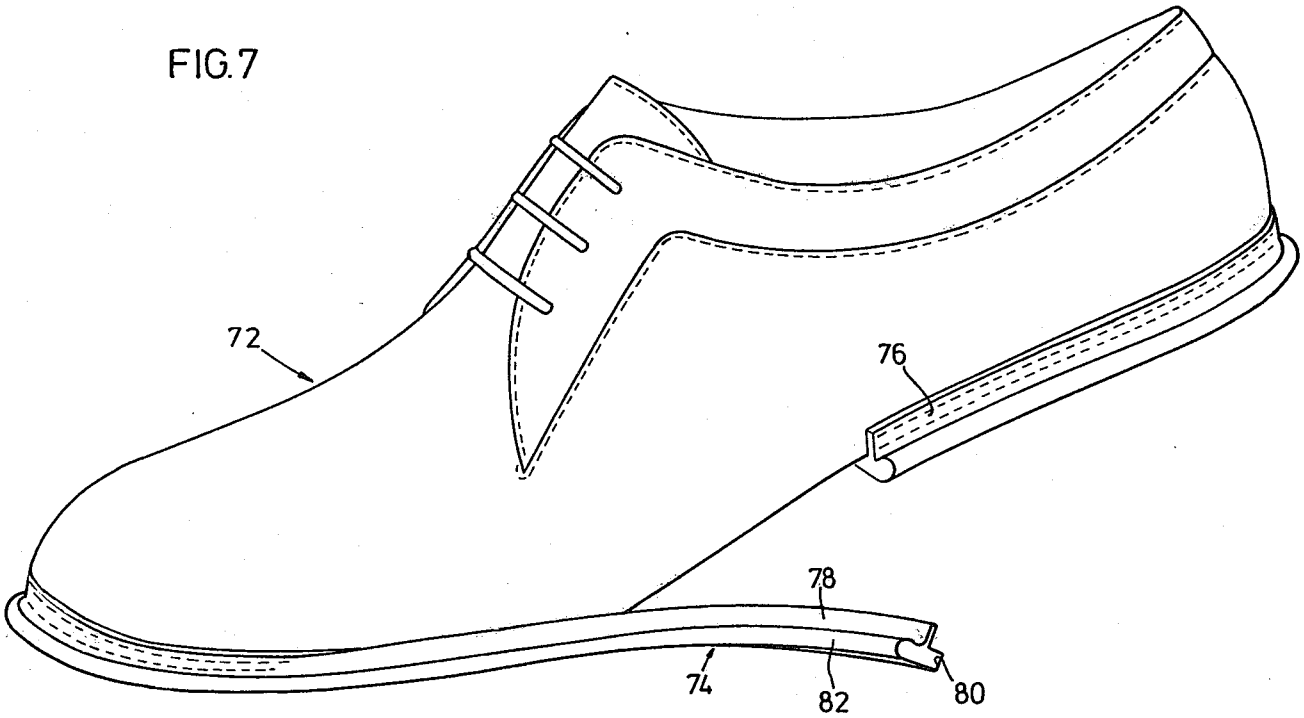
Figure 8:
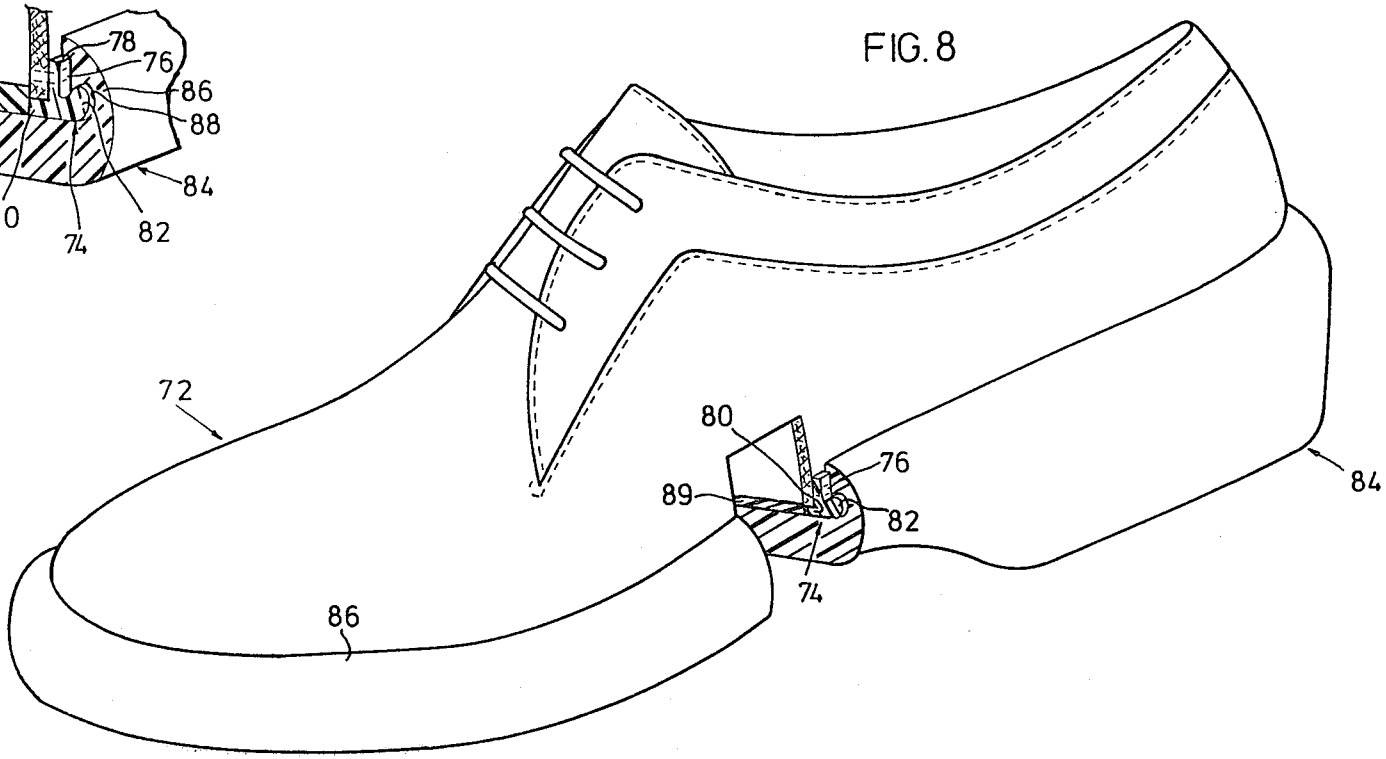
Figure 9:
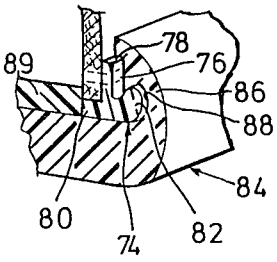
Figure 10:
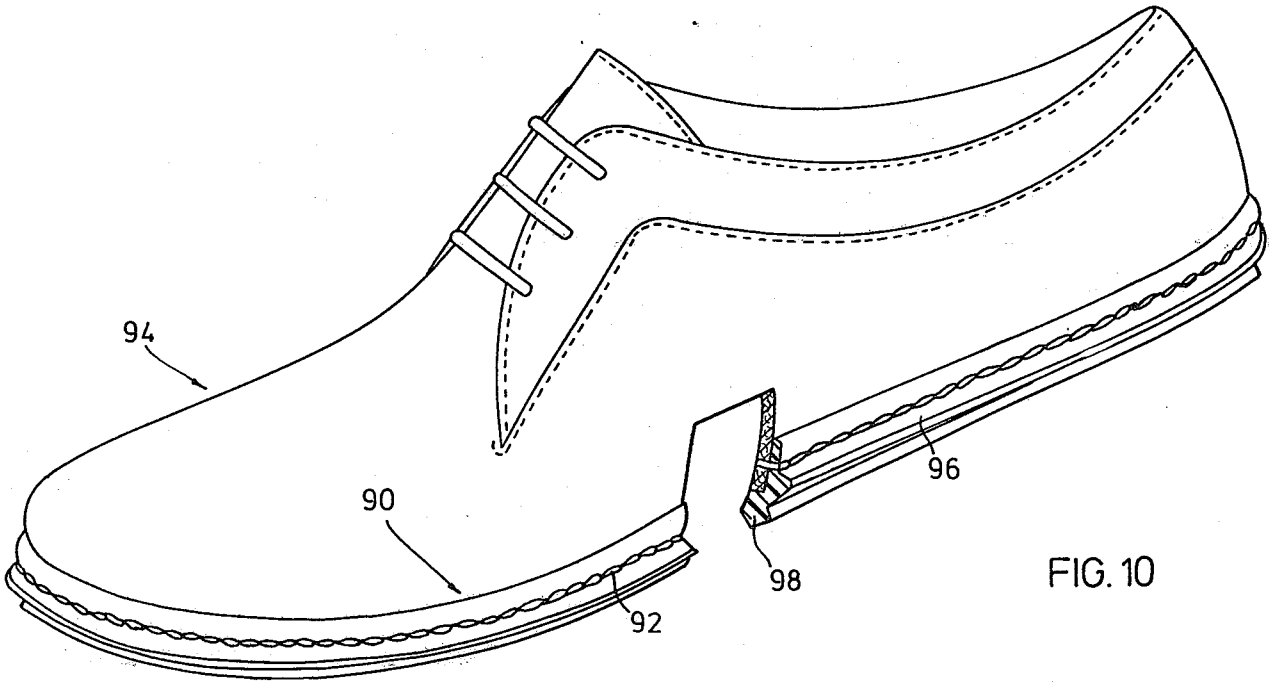
Figure 11:
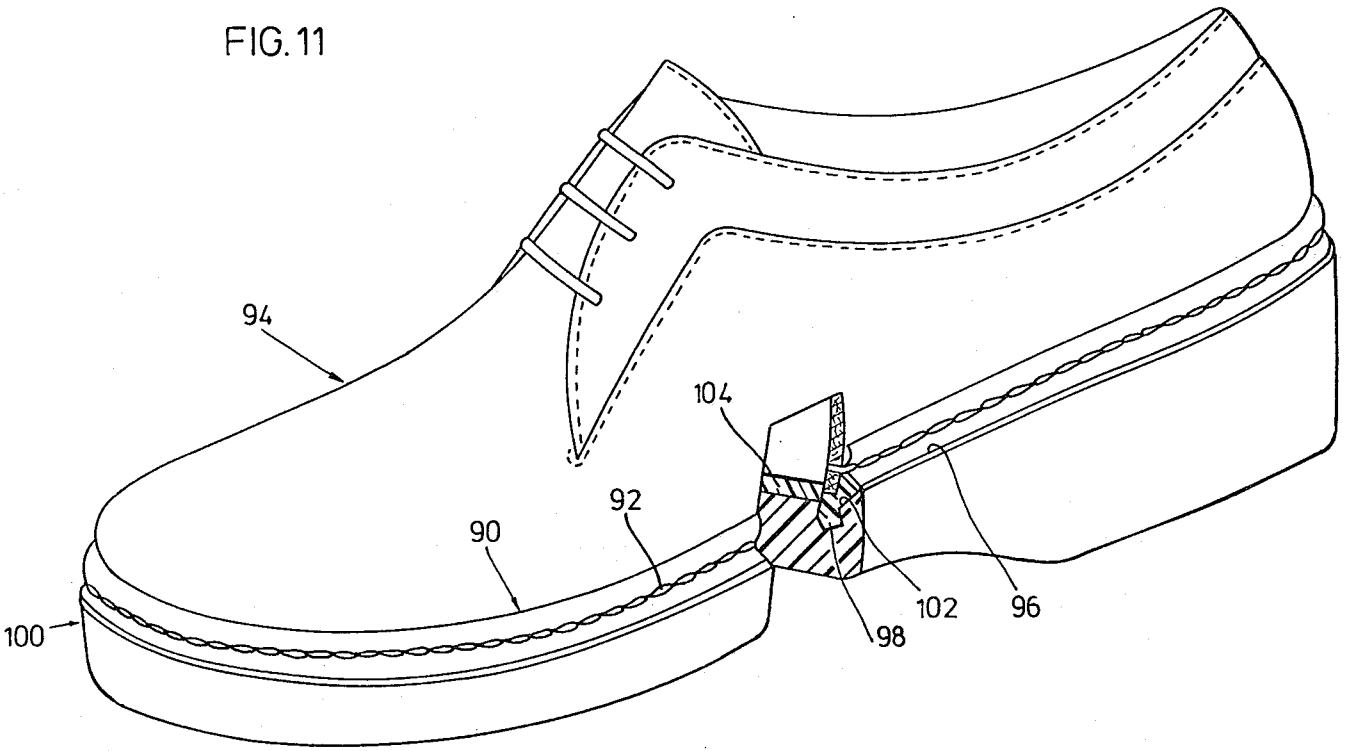
Figure 14:
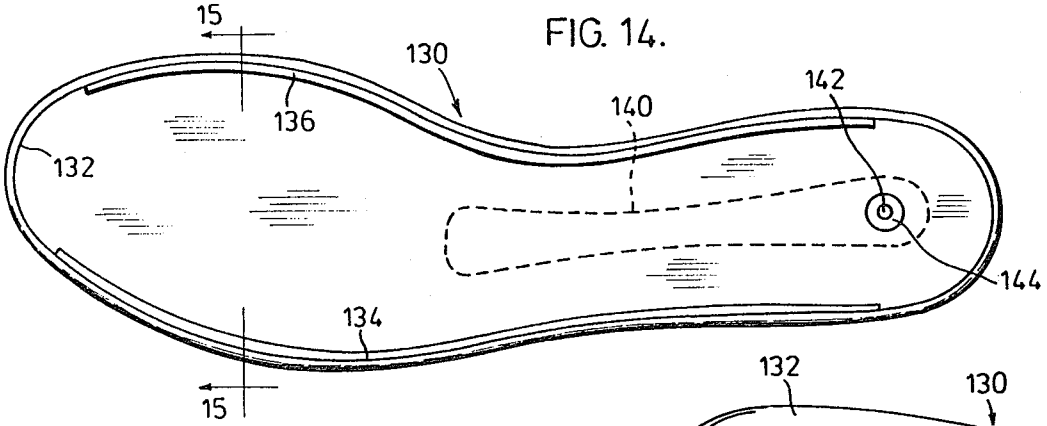
Figure 15:
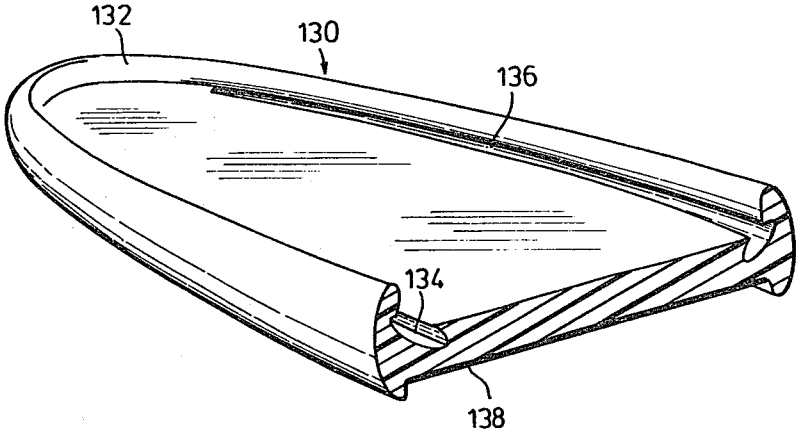
Figure 19:
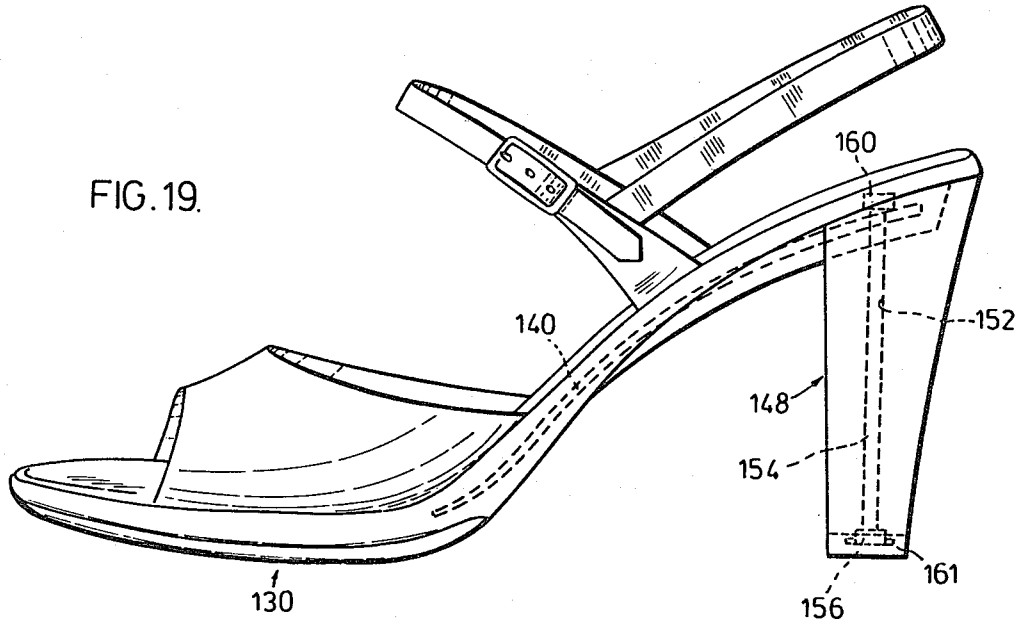

Embodiments of the invention will now be described, by way of example, with reference to the accompanying drawings, of which:

FIG. 1 is a perspective view of a shoe upper with a connecting strip partially attached thereto, FIG. 2 is a side view, partly broken away, of the shoe upper and connecting strip of FIG. 1, with a welt member attached thereto to form a shoe upper unit, FIG. 3 is an enlarged view of part of FIG. 2 showing the manner in which the welt member is attached to the connecting strip, FIG. 4 is a perspective view of the shoe upper unit of FIG. 2 and a sole and heel unit for attachment thereto, FIG. 5 is an exploded view of apparatus for attaching the shoe upper unit to the sole and heel unit, FIG. 6 is a perspective view showing a finished shoe, FIG. 7 is a perspective view of a shoe upper with a connecting strip partially attached thereto in accordance with a second embodiment, FIG. 8 is a similar view, partially broken away, of the shoe upper and connecting strip of FIG. 7 attached to a sole and heel unit, FIG. 9 is an enlarged view of part of FIG. 8 showing the manner in which the sole and heel unit is attached to the connecting strip, FIG. 10 is a perspective view, partly broken away, of a shoe upper with a connecting strip attached thereto in accordance with a third embodiment, FIG. 11 is a similar view showing the shoe upper and connecting strip of FIG. 10 attached to a sole and heel unit, FIG. 12 is a side view of preformed forward and rear upper parts with connecting strips attached thereto in accordance with a fourth embodiment, FIG. 13 is a side view of a sole unit attachable to the connecting strips of FIG. 12, FIG. 14 is a plan view of the sole unit, FIG. 15 is a sectional view of the sole unit taken along the line 15—15 of FIG. 14, FIG. 16 is a bottom view of the sole unit, FIG. 17 is a perspective view of a heel unit attachable to the sole unit, FIG. 18 is an exploded view showing the manner in which the heel is attachable to the sole unit, FIG. 19 is a side view of a completed shoe, FIG. 20 is a perspective view of the completed shoe, and FIG. 21 is an enlarged view, partly broken away of the forward end of the completed shoe.

Referring first to FIGS. 1 to 6, there is first provided a pre-formed shoe upper 12 of leather or other suitable material, the shoe upper 12 having been manufactured in a conventional manner except that the lower edge extension usually provided for attachment purposes is omitted. A connecting strip 14 of suitable plastic material, such as thermoplastic rubber known as TPR and of L-shaped section is then attached to the exterior of the shoe upper 12 around its lower edge portion 16 so that the connecting strip 14 extends completely around the upper 12, as indicated in FIG. 1 to effect such attachment. The outer lower edge portion 16 of the upper 12 is roughened and pre-cemented with a conventional shoe cement, and the face of the connecting strip 14 to be engaged therewith is similarly treated. The connecting strip 14 is then pressed into place and, if desired, may also be attached to the shoe upper 12 by stitching 18. The vertical arm 20 of the L-shaped section of the connecting strip 14 is in fact attached to the shoe upper 12 so that the horizontal arm forms an outwardly projecting ledge 22 extending around the bottom of the shoe upper 12.

As shown in FIGS. 2 and 3, a ring-like welt member 24 is then attached to the connecting strip 14. The welt member 24 is made of suitable plastic material, such as TPR, and has an internal L-shaped section with a vertical arm 26 and a horizontal arm 28 so shaped that the welt member 24 can be snapped into engagement with the projecting ledge 22 of the connecting strip 14. The vertical welt arm 26 is long enough to extend above the connecting strip 14, and the horizontal welt arm 28 is long enough to extend beneath the bottom of the connecting strip 14 to a position beneath the shoe upper 12 a short distance inwardly of its bottom edge.

The internal surfaces of the vertical welt arm 26 and horizontal welt arm 28 are recessed in a manner complimentary to the shape of the projecting ledge 22 of the connecting strip 14 so that, as mentioned above, the welt member 24 can be snapped into engagement with the connecting strip 14, with the arms 20, 22 of the connecting strip 14 fitting into the recessed surfaces of the welt member 24. The upper part of the welt member 24 extends across the top of the connecting strip 14 into engagement with the side wall of the shoe upper 12 so as to conceal the connecting strip 14.

Besides being snapped into engagement with the connecting strip 14, the welt member 24 may also be secured thereto by adhesive such as the shoe cement previously mentioned. This also enables the welt member 24 to be secured by adhesives to the parts of the shoe upper 12 with which the vertical and horizontal arms 26, 28 are in contact. While the adhesive is curing, the shoe upper may be mounted on a last and appropriate pressure applied to the welt member 24, for example by air bags, in a manner which will be apparent to a person skilled in the art.

As shown in FIGS. 2 and 3, the horizontal arm 28 of the welt member 24 extends for a short distance beyond the bottom edge of the shoe upper. An insole 30 is then inserted into the shoe upper and is supported by and adhesively secured to the inwardly projecting portion of the horizontal welt arm 28.

FIG. 5 shows an exploded view of apparatus for attaching the shoe upper unit formed by the upper 12, connecting strip 14 and welt member 24 to a pre-formed sole and heel unit 34, which may be constructed from suitable plastic material such as TPR. The upper surface of the sole and heel unit 34 is shaped to receive the upper unit, and in this respect the sole and heel unit 34 has a peripheral upper surface 36 shaped in a complementary manner to the lower surface of the horizontal arm 28 of the welt member 24, which lower surface it will be noted is V-shaped.

The apparatus shown in FIG. 5 includes a base 38 with a recess 40 corresponding to the shape of the sole and heel unit 34, the recess 40 containing a vertically movable sole and heel support plate 42. The sole and heel unit 34 is placed in the recess 40 with the support plate 42 being positioned so that the upper peripheral surface 36 of the sole and heel unit 34 is positioned slightly above the top of the recess 40, the peripheral surface 36 first having been precemented. A last 32 is positioned in the shoe upper unit 12, 24, and the V-shaped lower surface of the horizontal welt arm 28 is also pre-cemented.

The apparatus also includes a hinged guide plate 44 having two elongated plate-like parts 46, 48 hinged

METHOD OF MAKING FOOTWEAR

This application is a continuation-in-part of application Ser. No. 100,586, filed Dec. 5, 1979.

The present invention relates to a method of making articles of footwear and to articles of footwear made thereby.

Basic principles of construction of articles of footwear have remained the same for a number of years, the only significant changes being concerned with the replacement of skilled workers by complicated machinery. Such machinery is not only expensive in initial cost, but also requires a considerable amount of maintenance with the consequent cost not only of repair but also of lost production. Further, it is difficult to find a sufficient number of skilled workers to carry out conventional techniques of footwear manufacture.

It is therefore an object of the invention to provide a method of making footwear reduces the need for complicated machinery or of highly skilled workers.

According to one aspect of the present invention, a method of making an article of footwear includes providing a pre-formed upper having a peripheral lower edge portion, attaching a connecting strip to the peripheral lower edge portion of the upper so that the connecting strip surrounds the upper, the connecting strip having a profiled section providing a projecting extension, providing a pre-formed ring-like welt member, said welt member having an inner surface shaped for snapping engagement with the projecting extension of the connecting strip, snapping the welt member into engagement with the connecting strip, providing a preformed sole and heel unit with an upper peripheral surface engageable with a lower surface of the welt member, and attaching the sole and heel unit to the welt member by adhering the upper peripheral surface of the sole and heel unit to the lower surface of the welt member.

The present invention therefore requires the provision of various pre-formed units, namely an upper, a connecting strip, a welt member and a sole and heel unit, which can be assembled to produce articles of footwear by relatively unskilled workers without the necessity for complicated machinery.

The sole and heel unit may be attached to the welt member by locating the sole and heel unit in a correspondingly shaped recess in a base, and clamping the welt member and attached upper against the sole and heel unit, with adhesive previously having been provided over at least one of the welt member and the sole and heel unit.

The welt member may be clamped against the sole and heel unit by a guide plate having two parts hinged together at one end for opening and closing movement enabling the guide plate to be moved from an open position to a closed position around and over the welt member, and by clamps attached to the base and movable to engage the guide plate and apply clamping pressure through the guide plate to the welt member.

If desired, the welt member may be so shaped that it conceals the connecting strip after attachment thereto.

The present invention accordingly also provides an article of footwear comprising a pre-formed upper having a peripheral lower edge portion, a connecting strip attached to said lower edge portion and surrounding the upper, said connecting strip having a profiled section providing a projecting extension, a pre-formed ring-like welt member having an inner surface in snapping engagement with the projecting extension of the connecting strip, and a pre-formed sole and heel unit having an upper peripheral surface adhered to a lower surface of the welt member.

According to another aspect of the invention, a method of making an article of footwear includes providing a pre-formed upper having a peripheral lower edge portion, attaching a connecting strip to the peripheral lower edge portion of the upper so that the connecting strip surrounds the upper, said connecting strip having an profiled section providing a projecting extension, providing a pre-formed sole and heel unit with a peripheral wall internally profiled for snapping engagement with the projecting extension of the connecting strip, and snapping the sole and heel unit into engagement with the connecting strip. It will be noted that, with this aspect of the invention, the previously mentioned welt member is omitted, and such omission may be satisfactory with certain types of footwear.

The peripheral wall of the sole and heel unit may conceal the connecting strip after engagement therewith. Alternatively, the connecting strip may have an upper portion which remains exposed above the peripheral wall of the sole and heel unit after the sole and heel unit has been engaged with the connecting strip.

The present invention thus also provides an article of footwear comprising a pre-formed upper having a peripheral lower edge portion, a connecting strip attached to the lower edge portion and surrounding the upper, the connecting strip having a profiled section providing a projecting extension, and a pre-formed sole and heel unit with a peripheral wall having an internal surface in snapping engagement with the projecting extension of the connecting strip.

According to yet another aspect of the invention, a method of making an article of footwear includes providing a preformed forward upper part and a preformed rear upper part, each upper part having a pair of laterally spaced lower edge portions, attaching a first connecting strip to the edge portions of the forward and rear upper parts on one side thereof, attaching a second connecting strip to the edge portions of the forward and rear upper parts on the opposite side thereof, each connecting strip having a profiled section providing a projecting extension, providing a preformed sole unit with a peripheral wall internally profiled for snapping engagement with the projecting extensions of the connecting strips, and snapping the projecting extensions of the connecting strips into engagement with the sole unit on opposite sides thereof to position the forward and rear upper parts thereon.

The present invention thus also further provides an article of footwear comprising a preformed forward upper part and a preformed rear part, each upper part having laterally spaced lower edge portions, a first connecting strip attached to the edge portions of the forward and rear upper parts on one side thereof, a second connecting strip attached to the edge portions of the forward and rear upper parts on the opposite side thereof, each connecting strip having a profiled section providing a projecting extension, and a preformed sole unit having a peripheral wall with an internal surface in snapping engagement with the projecting extensions of the first and second connecting strips, the first and second connecting strips being on opposite sides of the sole unit to position the forward and rear upper parts thereon.

together at one end by a hinge pin 50 so that the opposite ends of the plate parts 46, 48 can be opened and closed. In the closed position, the plate parts 46, 48 form a recess 52 corresponding to the periphery welt member 24. The inner edges of the plate parts 46, 48 which form the recess 52 are profiled at 54 so as to fit onto the upper edge of the welt member 34. The plate parts 46, 48 have downwardly extending rods 56 which, in the closed position of the plate, fit into correspondingly positioned bores 58 in the base 38.

With the plate parts 46, 48 in the open position, the plate parts 46, 48 are positioned around the welt member 24 and then closed. The shoe upper unit 12, 14 containing the last 32 and with the guide plate 44 attached thereto is then positioned on the sole and heel unit 34, with the rods 56 fitting into the bores 58 in the base.

The base 38 has a pair of hinged clamps 60 at opposite ends with handles 62 and spigots 64. The clamps 60 are swung upwardly to move the spigots 64 across the ends of the guide plate 44 until the spigots 64 engage in apertures 66 in the guide plates 46, 48. Thus, the clamps 60 apply pressure downwardly through the guide plate 44 to the welt member 24. At the same time, upward pressure is applied in a suitable manner to the support plate 42, so that the engaging surfaces of the welt member 24 and the sole and heel unit 34 are forced against each other until the adhesive has set to permanently bond the welt member 24 to the sole and heel unit 34. The finished shoe is then removed by unfastening the clamp 60 and opening the guide plate 44, the finished shoe being shown in FIG. 6.

FIGS. 7 and 8 show an embodiment of the invention in which a shoe upper 72 has a connecting strip 74 secured thereto by adhesive and stitching 76. The sectional shape of the connecting strip 74 is somewhat different from that of the connecting strip 14 of the first embodiment. The connecting strip 74 has a section resembling an inverted T-shape with a central vertical arm 78 stitched and secured by adhesive to the upper 72, a first short horizontal arm 80 projecting inwardly under the bottom edge of the upper 72, and a second horizontal arm 82 projecting outwardly to form a ledge, with the upper and outer surfaces of the arm 82 having a somewhat bulbous shape.

A pre-formed sole unit 84 has a peripheral wall 86 with an internal recess 88 of complementary shape to that of horizontal arm 82 of the connecting strip 74, so that the sole and heel unit 84 can be snapped into engagement with the connecting strip 74, with the peripheral wall 86 firmly engaging and also concealing the connecting strip 74. Adhesive may also be used if desired. An insole 89 is then fitted in the upper 72 and secured to the upper surface of the sole and heel unit 84 by adhesive.

A third embodiment is shown in FIGS. 10, 11. A connecting strip 90 is secured by stitching 92 and adhesive to an upper 94, the connecting strip 90 having an irregular section which provides an outer ledge 96 and a downwardly angle extension 98 with an upper surface engaging the bottom edge of the upper 94. A preformed sole and heel unit 100 has its peripheral upper surface 102 shaped to receive a downward extension 98 of the connecting strip 90 in snapping engagement, such that the outer ledge 96 of the connecting strip is located immediately above and is flush with the periphery of the sole and heel unit 100. Thus, in this case, the upper part of the connecting strip 90 is visible above the sole unit 100 instead of being concealed as in the previous embodiment. An insole 104 is then fitted within the upper 94 in the same manner as described in connection with the previous embodiment.

If desired, the connecting strip may be an endless ring-like strip, especially in an embodiment such as that shown in FIGS. 10 and 11, rather than a strip of the correct finite length, such as shown in FIGS. 1 and 7.

As mentioned, thermoplastic rubber, known as TPR, is the most suitable material for the connecting strip, welt member and sole and heel unit, with the TPR for each part having the softness or hardness required for the part concerned.

FIGS. 12 to 21 show a fourth embodiment of the invention, which is especially useful with ladies' high heel dress or casual sandals or open toe or open heel shoes. In this embodiment, a shoe has a preformed forward upper part 112 and a preformed rearward upper part 114, these upper parts being of leather or suitable man-made material. In use, the forward upper part 112 extends across the forward upper part of the foot rearwardly of the toes, and the rear upper part 114 is in the form of a strap 116 with buckle 118 which extends across the rear part of the foot and a strap 120 which extends around the heel from one side to the other.

Two connecting strips 122, 124 of for example thermoplastic rubber each have a profiled section forming a projecting extension 126, 128 respectively. The first connecting strip 122 is connected by sewing to the lower edges of the forward upper part 112 and rear upper part 114 on one side thereof, and the second connecting strip 124 is similarly connected on the opposite side, such that the rear upper part 114 is rearwardly spaced from the forward upper part 112.

A preformed sole unit 130 in the form of a platform member is made of a rigid molded plastic material such as styrene. The sole unit 130 has a peripheral wall 132 extending completely around its upper surface, and has longitudinally extending recesses 134, 136 at the junction of the peripheral wall 132 and the upper surface of the sole unit on opposite sides thereof, the recesses 134, 136 extending from a position near the front end of the sole unit to a position near the rear end thereof. Recesses 134 and 136 are shaped to enable the projecting extensions 126, 128 of the connecting strips 122, 124 respectively to be snapped into engagement therewith.

The underside of the front end of the sole unit 130 has a recess 138, as shown in FIGS. 15 and 16, into which a preformed sole pad insert 139 is secured by suitable adhesive at this stage, the sole insert 139 being shown in FIGS. 19, 20, and 21.

The connecting strips 122, 124 can readily be snapped into engagement with the recesses 134, 136 in the sole unit 130, as indicated in FIGS. 19, 20 and 21, and the engaging surfaces may be previously treated with adhesive to form a more secure connection if desired.

The sole unit 130 has a longitudinal preformed steel reinforcing spine 140 positioned therein during manufacture, the spine 140 extending over the rear part of the sole unit 130 as shown in FIGS. 14 and 19. Near its rear end, the shank 140 has an aperture 142 which is aligned with a vertical bore 144 in the sole unit 130. The underside of the rear end part of the sole unit 130 has an integral tenon portion 146 of a mortice and tenon joint, with the bore 144 extending therethrough. A preformed heel 148 of rigid molded plastic material such as styrene, shown in FIG. 17, has an upper surface with the mortice portion 150 of the joint and a bore 152 extending therethrough from the upper surface to the bottom surface of the heel 148.

The heel 148 is assembled with the sole unit 130 by sliding the mortice portion 150 of the heel 148 forwardly into engagement with the tenon portion 146 on the sole unit. A bolt 154 with a head 156 is passed upwardly through the heel 148 so that the head 156 sits in a correspondingly shaped recess 158 in the bottom of the heel 148. A nut 160 is then screwed onto the threaded end of the bolt 154, whose length is such that the nut 160 is positioned in the upper end of the bore 144 in the sole unit, the upper end being countersunk for this purpose. A heel top-lift 161 is then secured to the bottom of the heel 148 in the usual way.

Finally, a light insole 162 is secured by adhesive to the upper surface of the sole unit 130 within the peripheral wall 132, as indicated in FIGS. 20 and 21. The insole 162 preferably comprises foam cushion material with a covering of leather or suitable man-made material.

The above embodiments clearly demonstrate the advantages of the present invention in that various preformed units of an article of footwear can be assembled by relatively unskilled workers without the necessity for complicated machinery. In this respect, proper location points may be indicated on the various parts to fecilitate correct assembly.

Other embodiments within the scope of the invention will be readily apparent to a person skilled in the art, the scope of the invention being defined in the appended claims.

What I claim as new and desire to protect by Letters Patent of the United States is:

1. A method of making an article of footwear including providing a preformed forward upper part and a preformed rear upper part, each upper part having a pair of laterally spaced lower edge portions, attaching a first connecting strip to the edge portions of the forward and rear upper parts on one side thereof, attaching a second connecting strip to the edge portions of the forward and rear upper parts on the opposite side thereof, each connecting strip having a profiled section providing a projecting extension, providing a preformed sole unit with a peripheral wall internally profiled for snapping engagement with the projecting extensions of the connecting strips, and snapping the projecting extensions of the connecting strips into engagement with the sole unit on opposite sides thereof to position the forward and rear upper parts thereon.

2. A method according to claim 1 wherein the sole unit is provided with a rear undersurface having a tenon portion of a mortice and tenon joint, and a heel unit with a mortice of said joint in an upper surface thereof is also provided, the method including sliding the mortice portions of the heel forwardly into engagement with the tenon portions of the sole unit.

3. A method according to claim 2 wherein the sole unit is provided with a vertical bore passing therethrough near the rear end thereof and a reinforcing spine extending longitudinally of the sole unit and having an aperture aligned with the vertical bore of the sole unit, and the heel unit is provided with a bore extending therethrough from an upper to a lower end, the method including securing the heel unit in assembly with the sole unit by a securing bolt passing through the bore in the heel unit and the vertical bore and the spine of the sole unit.

* * * * *